US007648311B2

(12) United States Patent
Hedrick

(10) Patent No.: US 7,648,311 B2
(45) Date of Patent: Jan. 19, 2010

(54) CABLE BOLT

(75) Inventor: Neville Hedrick, Wangara (AU)

(73) Assignee: Garford Pty Ltd (AU)

( * ) Notice: Subject to any disclaimer, the term of this patent is extended or adjusted under 35 U.S.C. 154(b) by 345 days.

(21) Appl. No.: 10/566,418

(22) PCT Filed: Jul. 30, 2004

(86) PCT No.: PCT/AU2004/001009

§ 371 (c)(1),
(2), (4) Date: Aug. 4, 2006

(87) PCT Pub. No.: WO2005/012691

PCT Pub. Date: Feb. 10, 2005

(65) Prior Publication Data

US 2007/0183850 A1 Aug. 9, 2007

(30) Foreign Application Priority Data

Aug. 1, 2003 (AU) ..... 2003904006

(51) Int. Cl.
*E21B 21/00* (2006.01)

(52) U.S. Cl. ..... 405/259.1; 405/259.5; 405/302.2; 411/82; 411/82.1

(58) Field of Classification Search ..... 405/259.1, 405/259.4, 259.5, 302.2; 411/82, 82.1, 82.2, 411/82.3; 57/200, 210, 222
See application file for complete search history.

(56) References Cited

U.S. PATENT DOCUMENTS

| | | | | |
|---|---|---|---|---|
| 3,091,990 | A * | 6/1963 | McVittie | 411/27 |
| 3,332,244 | A * | 7/1967 | McLean | 405/259.5 |
| 4,790,129 | A | 12/1988 | Hutchins | |
| 5,344,256 | A | 9/1994 | Hedrick | |
| 5,531,545 | A * | 7/1996 | Seegmiller et al. | 405/259.4 |
| 5,699,572 | A * | 12/1997 | Castle et al. | 7/138 |
| 5,954,455 | A | 9/1999 | Eaton et al. | |
| 6,270,290 | B1 | 8/2001 | Stankus et al. | |

FOREIGN PATENT DOCUMENTS

| | | |
|---|---|---|
| GB | 2 265 394 | 9/1993 |
| WO | WO 93/15279 | 8/1993 |

* cited by examiner

*Primary Examiner*—David J Bagnell
*Assistant Examiner*—Sean D Andrish
(74) *Attorney, Agent, or Firm*—Faegre & Benson LLP

(57) ABSTRACT

A cable bolt is provided that is suited to stabilize rock surfaces, particularly to withstand loads placed on the cable bolt when tensioned to stabilize rock surfaces of coal mines. The cable bolt comprises a tendon composed of a plurality of strands, the tendon having a plurality of pre-formed bulbous portions. The bulbous portions house rigid elements, such as a ball bearing, which are inserted after the bulbous portions are formed. When the cable bolt is tensioned or stressed, the load placed on the bulbous portion will be resisted by the rigid element housed within the bulbous portion, thereby preventing the bulbous portion from collapsing.

11 Claims, 2 Drawing Sheets

CABLE BOLT

FIELD OF THE INVENTION

The present invention relates to an improved cable bolt, in particular to an improved cable bolt adapted for use in coal mining.

BACKGROUND OF THE INVENTION

Cable bolts are steel tendons inserted into bore holes in a rock surface to stabilize the rock surface against collapse. In hardrock mining, the whole length of the tendon is grouted, and a plate is attached to the tendon adjacent to the rock surface. The tendon is then stressed; the plate bears upon the rock surface and thereby stabilizes the rock surface.

Tendons typically comprise a plurality of steel strands wound together to form the tendon. It is known to provide multi-stand cable bolts that are formed with bulbs or expanded portions in order to increase the surface area of the tendon in contact with the grout to more securely embed the tendon in the grout. The bulbs or expanded portions thus increase the radial confinement of the tendon within the borehole.

In coal mining, where any movement of the rock surface is undesirable, an end portion of the tendon disposed innermost in the bore hole is secured therein by spinning the end portion in resin, attaching a resin dam to an opposing end of the spun end portion, and allowing the resin to cure. The remaining portion of the tendon disposed in the borehole is then tensioned to immediately stabilize the rock surface. The bore hole can then be grouted safely a short time later. In the meantime, the rock surface is stabilized against collapse before grouting commences or during the grout curing period.

When multi-strand cable bolts provided with bulbs or expanded portions are used to stabilize a rock surface of a coal mine, as described above, the bulbs or expanded portions tend to collapse under the load placed on the cable bolt when the tendon is tensioned to stabilize the rock surface. This type of multi-strand cable bolt is thus rendered ineffective as an anchoring means for coal mine rock surfaces, as the collapsed bulbs do not afford sufficient surface area to bond with the grout and the tendon "stretches" or lengthens as the bulbs collapse.

The present invention attempts to overcome at least in part some of the aforementioned disadvantages.

SUMMARY OF THE INVENTION

In accordance with a first aspect of the present invention there is provided an improved cable bolt comprising a tendon composed of a plurality of strands, the tendon having a plurality of bulbous portions, wherein all the strands in each bulbous portion are spaced apart from one another substantially around the periphery of each bulbous portion, and a plurality of rigid elements, wherein the bulbous portions house the rigid elements, such that there is a minimal clearance between an outermost surface of the rigid element and a broadest part of a cavity of the bulbous portion.

BRIEF DESCRIPTION OF THE DRAWINGS

The present invention will now be described, by way of example, with reference to the accompanying drawings, in which.

DESCRIPTION OF THE INVENTION

Figure 1:
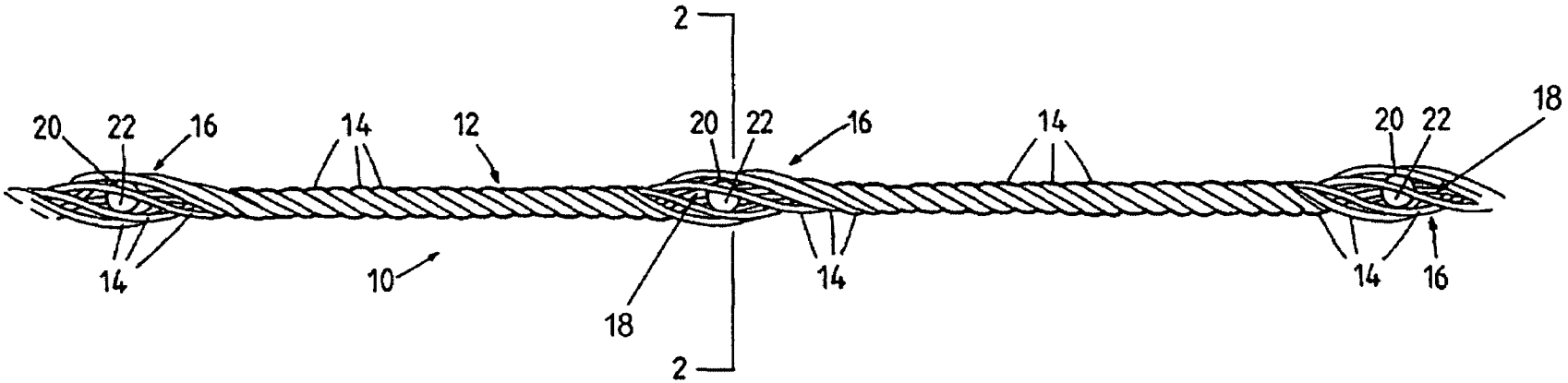
FIG. 1 is a view of a cable bolt in accordance with the present invention.

Referring to the Figures, wherein like numerals and symbols refer to like parts throughout, there is shown a cable bolt 10 comprising a steel tendon 12. The tendon 12 is composed of a plurality of outer strands 14 helically wound around a centre strand 15 to form the tendon 12. As shown, there are six outer strands 14 wound around the centre strand 15. The tendon 12 has a plurality of bulbous portions 16 spaced apart from one another along the length of the tendon 12.

Figure 2:
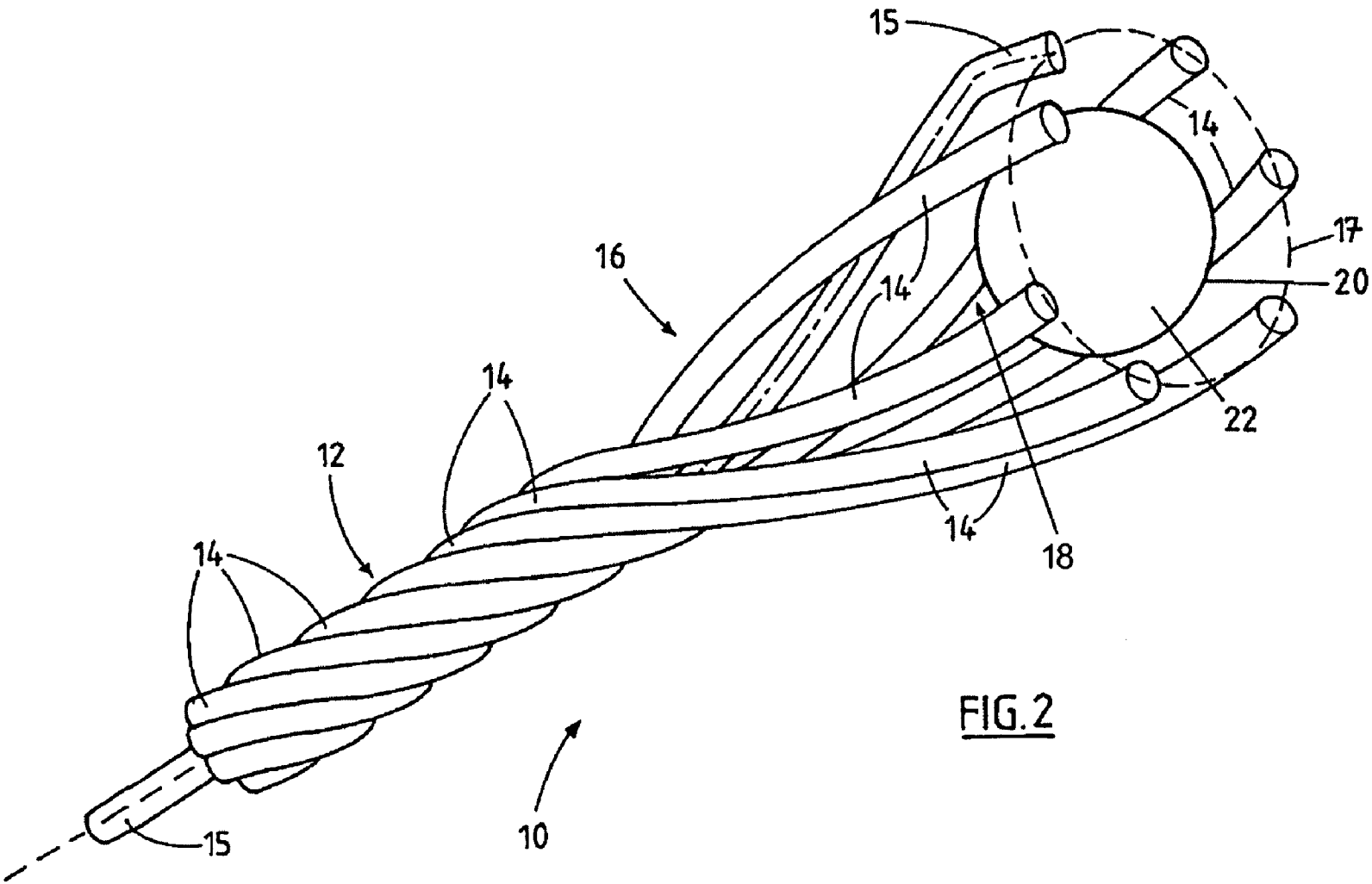
FIG. 2 is an upper perspective view of a section taken along the line 2-2 of FIG. 1

The portions of the strands 14 and 15, in the bulbous portions 16, are spaced apart from each other around the circumference of the bulbous portions 16, as shown. The section line 2-2 has been taken through the broadest part of the bulbous portion 16. As seen in FIG. 2, the centre strand 15 is displaced away from the centre of the tendon 12. Typically, the bulbous portion 16 has a bulb diameter substantially as large as the diameter of the smallest tube through which the cable bolt 10 will pass.

The bulb periphery is indicated by the broken lines, marked 17 in FIG. 2. The outer strands 14 and the centre strand 15 are all located adjacent and within the bulb periphery 17.

The bulbous portion 16 houses a rigid element 20 within a cavity 18 defined by the outer strands 14 and the centre strand 15. Preferably, the rigid element 20 is a solid sphere, such as a steel ball bearing. It is envisaged that there will be minimal clearance between the outermost surface 22 of the rigid element 20 and the broadest part of the cavity 18 of the bulbous portion 16. Typically, the minimal clearance will range from 0.2 mm to 3 mm.

The rigid element 20 is inserted into the bulbous portion 16 after the bulbous portion 16 has been formed. Typically, two of the strands 14, 15 are prised apart from one another by inserting a wedge member into the cavity 18 of the bulbous portion 16 between two of the strands 14, 15. The rigid element 20 is then inserted into the cavity 18 through a gap defined by the prised apart strands 14, 15. A rod member may be used to retain the rigid member 20 in the cavity 18 while the wedge member is retracted from between the prised apart strands 14, 15. When the wedge member is retracted the inherent tension in the prised apart strands 14, 15 encourages the strands 14, 15 to return to their original configuration in the bulbous portion 16. The rod member is then also retracted from the cavity 18 through the strands 14, 15, leaving the rigid member 20 encaged in the cavity 18 of the bulbous portion 16.

It will be appreciated that the bulb diameter of the bulbous portion 16 can vary according to the number and diameter of the strands 14, 15 used to form the tendon 12, and may be selected to suit the type of rock face in which the cable bolt 10 is intended to be inserted. For example, the bulb diameter may vary from 30 mm to 60 mm, but may be larger depending on the diameter of the strands 14, 15, the tendon 12, and the requirements of the application. Furthermore, the cable bolt 10 can be formed wherein the bulb diameter of specific bulb portions 16 may vary along the length of the cable bolt 10.

Accordingly, the size of the rigid element 20 housed in the cavity 18 of the bulbous portion 16 may be selected such that there is minimal clearance between the outermost surface 22 of the rigid element 20 and the broadest part of the cavity 18 of the bulbous portion 16.

The bulb frequency is defined as the distance between bulbous portions 16 along the length of the cable bolt 10. The bulb frequency will vary and be selected to suit the type of rock face in which the cable bolt 10 is intended to be inserted. For example, in hard rock mining the bulb frequency can be up to one bulbous portion 16 per metre, whereas in coal mining, where a very stiff cable bolt 10 is required, the bulb frequency can be up to one bulbous portion 16 per 250 mm.

Furthermore, it will be appreciated that the bulb frequency can vary along the length of the cable bolt 10.

The cable bolt 10 is also provided with a breather tube, for egress of air out of the borehole when grout is being pumped into the borehole. The breather tube is securely fastened adjacent to, and along the whole length of, the cable bolt 10 by suitable fastening means, such as electrical conduit clips.

In use, the cable bolt 10 is inserted into a bore hole drilled in a rock face. An end portion of the cable bolt 10 disposed innermost in the bore hole is secured therein by spinning the end portion in resin, attaching a resin dam to an opposing end of the spun end portion, and then allowing the resin to cure.

The resin is adapted to encase at least the innermost bulbous portions 16 in the borehole such that typically the innermost 2 to 4 bulbous portions 16 are encased in resin.

At an outermost end of the spun portion of the cable bolt 10 there is provided a resin dam comprising a seal of silicon which typically encases an adjacent bulbous portion 16 of larger diameter than the innermost bulbous portions 16 encased in resin. The large bulbous portion 16 is also typically shrinkwrapped in polyethylene plastic. The purpose of the large bulbous portion 16 is to prevent resin being forced down and out of the borehole during the "spinning" operation, thereby acting as a bung or seal.

Alternatively, the cable bolt 10 may be provided with a flange and complimentary washer, a clamp, or a swage with complimentary washer to prevent the resin from being forced down the hole. The remaining portion of the cable bolt disposed in the borehole is then tensioned to immediately stabilize the rock surface.

When the cable bolt 10 is tensioned or stressed, the load placed on the bulbous portion 16 will be resisted by the rigid element 20 housed within the bulbous portion 16, thereby preventing the bulbous portion 16 from collapsing.

The borehole is then filled with grout, which is allowed to cure and solidify. The grout contacts a greater surface area of the strands 14 in use, as hereinbefore described. The cable bolt 10 is thereby firmly embedded in the grout.

In the meantime, the rock surface is stabilized against collapse before grouting commences or during the grout curing period.

Modifications and variations as would be apparent to a skilled addressee are deemed to be within the scope of the present invention.

The invention claimed is:

1. A cable bolt, comprising:

a tendon composed of a plurality of strands, the tendon having a plurality of spaced-apart bulbous portions, wherein all the strands in each bulbous portion are spaced apart from one another substantially about a periphery of each bulbous portion; and a plurality of rigid elements each including an outermost surface, wherein each of the bulbous portions houses one of the rigid elements and all the strands of the tendon extend at least in part around the outermost surface of the rigid element contained in the bulbous portion, wherein there is minimal clearance between the outermost surface of the rigid element and a broadest part of the bulbous portion.

2. The cable bolt according to claim 1, wherein a bulb diameter of the bulbous portions varies along a length of the cable bolt.

3. The cable bolt according to claim 1, wherein a bulb frequency of the bulbous portions varies along a length of the cable bolt.

4. The cable bolt according to claim 1, wherein the rigid element is a solid sphere.

5. The cable bolt according to claim 1, wherein the minimal clearance is about 0.2 mm (0.008 inches) to about 3 mm (0.118 inches).

6. A cable bolt used to stabilize a surface or face against collapse, the cable bolt comprising:

a tendon including a plurality of strands, the tendon having a plurality of spaced-apart bulbous portions, wherein all the strands in each of the bulbous portions are spaced apart from one another substantially about a periphery of each of the bulbous portions; and a plurality of rigid elements each including an outermost surface, wherein each of the bulbous portions houses one of the rigid elements and all the strands of the tendon extend at least in part around the outermost surface of the rigid element contained in the bulbous portion.

7. A method of forming a cable bolt including a tendon composed of a plurality of strands, the tendon having a plurality of spaced-apart pre-formed bulbous portions, wherein all the strands in each of the bulbous portions are spaced apart from one another substantially about a periphery of each of the bulbous portions forming a cavity, the method comprising the steps of:

a) prising apart two of the strands of the pre-formed bulbous portion;

b) inserting a rigid element including an outermost surface into the pre-formed bulbous portion; and c) releasing the prised apart strands such that an inherent tension in the prised apart strands encourages the strands to return to an original configuration of the preformed bulbous portion, wherein all the strands of the tendon extend at least in part around the outermost surface of the rigid element contained in the bulbous portion.

8. A cable bolt, comprising:

a tendon including a plurality of strands, the tendon having a plurality of spaced-apart pre-formed bulbous portions, wherein all the strands in each of the pre-formed bulbous portions are spaced apart from one another substantially around a periphery of each of the pre-formed bulbous portions; and a plurality of rigid elements each including an outermost surface, wherein one of the rigid elements is inserted into one of the pre-formed bulbous portions and housed therein and all the strands of the tendon extend at least in part around the outermost surface of the rigid element contained in the bulbous portion.

9. A method of forming a cable bolt including a tendon including a plurality of strands, the method comprising the steps of:

a) forming a plurality of spaced-apart bulbous portions within the strands of the tendon;

b) prising apart two of the strands of one of the bulbous portions;

c) inserting a rigid element having an outermost surface into the bulbous portion; and d) releasing the prised apart strands such that an inherent tension in the prised apart strands encourages the strands to return to an original configuration of the bulbous portion, such that the rigid element remains housed within the bulbous portion, wherein all the strands of the tendon extend at least in part around the outermost surface of the rigid element contained in the bulbous portion.

10. The method of claim 9, wherein the step of forming each bulbous portion comprises spacing apart all the tendon strands from one another substantially about a periphery of the bulbous portion.

11. The method of claim 9, further comprising the step of encasing in resin one or more of the bulbous portions at an end of the cable bolt to be inserted first into a borehole.

* * * * *

UNITED STATES PATENT AND TRADEMARK OFFICE

CERTIFICATE OF CORRECTION

PATENT NO. : 7,648,311 B2
APPLICATION NO. : 10/566418
DATED : January 19, 2010
INVENTOR(S) : Neville Hedrick It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 697 days.

Signed and Sealed this

Sixteenth Day of November, 2010

David J. Kappos

David J. Kappos
*Director of the United States Patent and Trademark Office*